United States Patent [19]

Feldman et al.

[11] Patent Number: 4,533,203

[45] Date of Patent: Aug. 6, 1985

[54] CONNECTOR FOR PRINTED CIRCUIT BOARDS

[75] Inventors: Steven Feldman, Seminole; Richard J. Cihak, Largo, both of Fla.

[73] Assignee: AMP Incorporated, Harrisburg, Pa.

[21] Appl. No.: 559,129

[22] Filed: Dec. 7, 1983

[51] Int. Cl.[3] ..... H01R 9/09

[52] U.S. Cl. ..... 339/176 M; 339/17 LM; 339/186 M; 339/210 M

[58] Field of Search ..... 339/17 LC, 17 LM, 17 M, 339/176 M, 64 R, 64 M, 210 R, 210 M, 186 M

[56] References Cited

U.S. PATENT DOCUMENTS

| | | | |
|---|---|---|---|
| 3,215,968 | 11/1965 | Herrmann | 339/17 LM |
| 3,430,182 | 2/1969 | Blanche | 339/17 M |
| 3,550,062 | 12/1970 | Drenten et al. | 339/17 LM |
| 3,601,762 | 8/1971 | Eshelman | 339/64 M |
| 4,050,769 | 9/1977 | Ammon | 339/210 M |

FOREIGN PATENT DOCUMENTS

| | | | |
|---|---|---|---|
| 2845632 | 5/1979 | Fed. Rep. of Germany | 339/176 M |

*Primary Examiner*—John McQuade

*Attorney, Agent, or Firm*—F. Brice Faller

[57] ABSTRACT

Connector for right angle printed circuit board interface comprises two-piece dielectric housing with right angle contact elements therein each having a first arm and a second arm with respective first and second ends. First ends are pins fixed to a daughter card while second ends are compliant with surface contacts on a mother board. Compliance is provided by lateral flexure of first arms while the second arms move axially as second ends bear against surface contact. The second arms have bearing portions at an oblique angle to the board which are resiliently disposed against like angled surfaces in the housing so that second ends shift laterally during application to provide wiping. An aligning fixture on the mother board also serves as keying means.

5 Claims, 7 Drawing Figures

CONNECTOR FOR PRINTED CIRCUIT BOARDS

BACKGROUND OF THE INVENTION

The present invention relates to a connector for printed circuit boards, and particularly to a connector fixed to a daughter board which mates with surface contacts on a mother board.

Printed circuit boards in the form of daughter cards are pluggably connected to mother boards to allow ready replacement of the cards or expansion of a system. Connection is generally provided by card-edge type connectors which are fixed to the mother board and contact pads on an inserted daughter card directly, as shown in U.S. Pat. No. 3,397,381, or by means of a two-piece arrangement where a connector fixed to the daughter card having contacts therein which mate with contacts in a connector fixed to a mother board. This is exemplified by U.S. Pat. No. 3,864,000, wherein right angle pins mounted in a housing and soldered into holes in a daughter card are mated with socket members mounted in a housing and soldered into holes in a mother board. Recently the two-piece arrangement has become more popular since the board-to-board pinout density of a card edge connector is limited by the linear space available on the edge of the daughter board, allowing increased contact density only by reduced pad width and closer centerline spacing. The result is increased potential for mismating, which would necessitate tighter manufacturing tolerances on both boards and connectors, which tolerances are not economically realistic. Two-piece connectors are not limited in the same fashion since more rows of contacts can be added. Using the circuit board edge for the connection also causes problems associated with warpage, variations in board thickness, and the 0.062 inch thickness limitation imposed by standard card-edge connector design. Two piece connectors, while solving some of the above problems, are inherently more expensive. Either of the common prior art arrangements requires a connector with contacts therein which are received in through holes in the mother board. Systems are often sold with these connectors attached to the mother boards where the daughter cards are only to be optionally provided in the event the system is expanded. Thus, where daughter cards are not ultimately used, unnecessary cost of holes and connectors is suffered. In any event, it would be desirable to provide an arrangement where connectors fixed to a daughter card could make electrical contact with surface contacts on a mother board. This would cost less than providing connectors on the mother board and would provide the same advantages over card edge technology as two-piece connectors.

The surface contact arrangement dictated by the above considerations would necessarily require aligning means on the mother board and further would require resilient compliance of contact elements with surface contacts on the mother board. Additionally, wiping action during contact engagement is desirable as in any contact mating.

SUMMARY OF THE INVENTION

The present invention resides in a connector having right angle contact elements which are fit into passages in a two-piece dielectric housing. A first arm of each element has a pin end which protrudes from the housing and is soldered to a through-hole in the daughter board. This arm is disposed for lateral resilient movement between a fulcrum or fixing point in the passage and a bend where the first arm joins the second arm. The second arm has a second end which is folded against itself to present a rounded contact surface which protrudes slightly from the face of the housing. The second arms move axially in the passages as the first arms flex and the second ends are brought to bear resiliently against surface contacts on the mother board. The second ends also shift laterally due to a slightly oblique angle of the end portion or bearing section sliding against a like angled bearing surace in the passage proximate the mating face, thus providing wiping engagement.

The housing portions are held together by keying elements which slide in dovetail grooves in one portion, which elements by their placement also serve to align and key the connector to a keying block fixed to the mother board. The keying block has like keys therein which are placed to assure mating with only the proper connector.

The invention thus permits a mother board with add-on capacity where the only fixture required is a keying block which may be economically molded of plastic.

BRIEF DESCRIPTION OF THE DRAWINGS

FIG. 6 is a sectioned perspective of the housing portions.

DETAILED DESCRIPTION OF THE INVENTION

Figure 1:
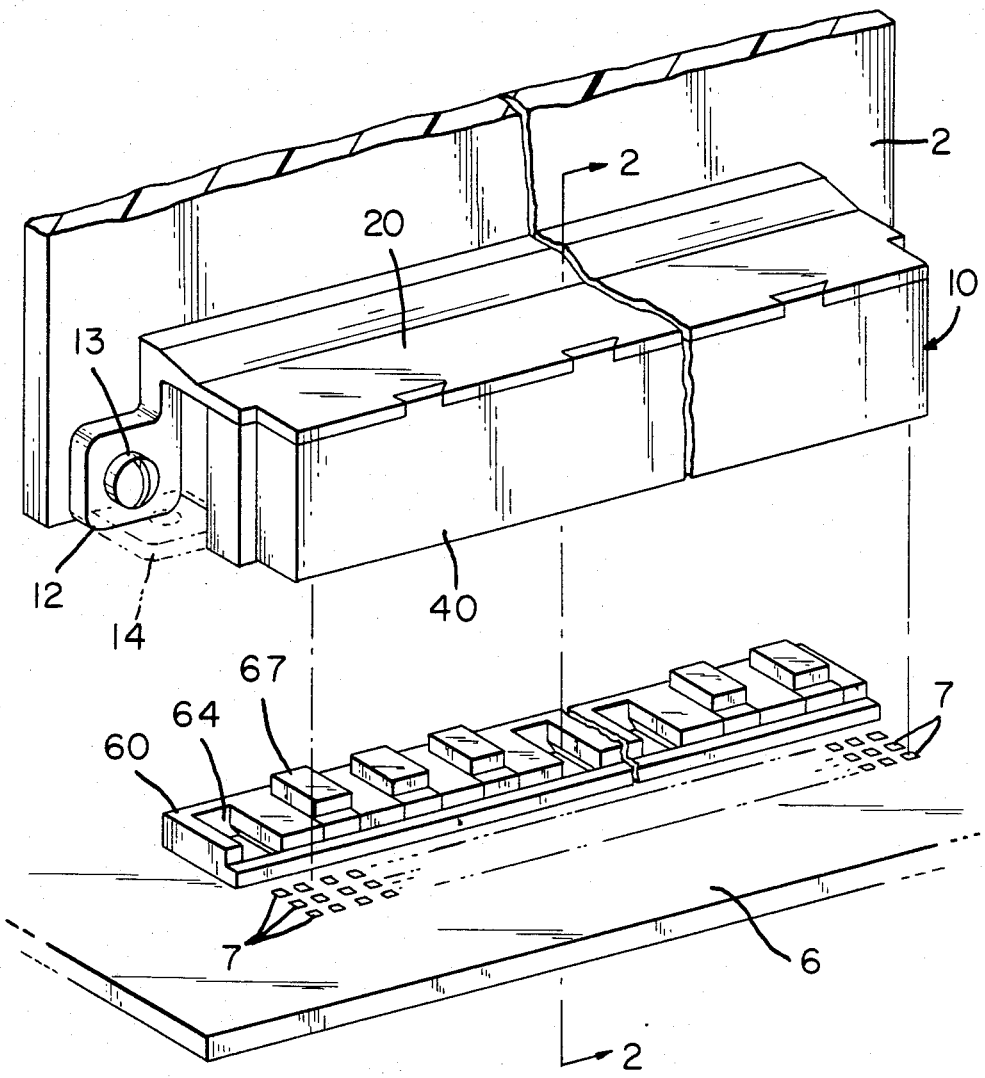
FIG. 1 is a perspective of the connector fixed to a daughter board.

FIG. 1 shows the connector 10 of the present invention fixed to a daughter card 2 by screws 13 through flanges 12. The connector 10 comprises a first dielectric housing portion 20 and a second dielectric housing portion 40 keyed together as will be described. The connector 10 mates with a keying block 60 which is fixed to mother board 6 in a precise relationship with surface contacts 7 thereon; keys 67 are positioned in apertures 64 through block 60 in a predetermined array which assures that only the proper daughter card will be emplaced.

Figure 2:
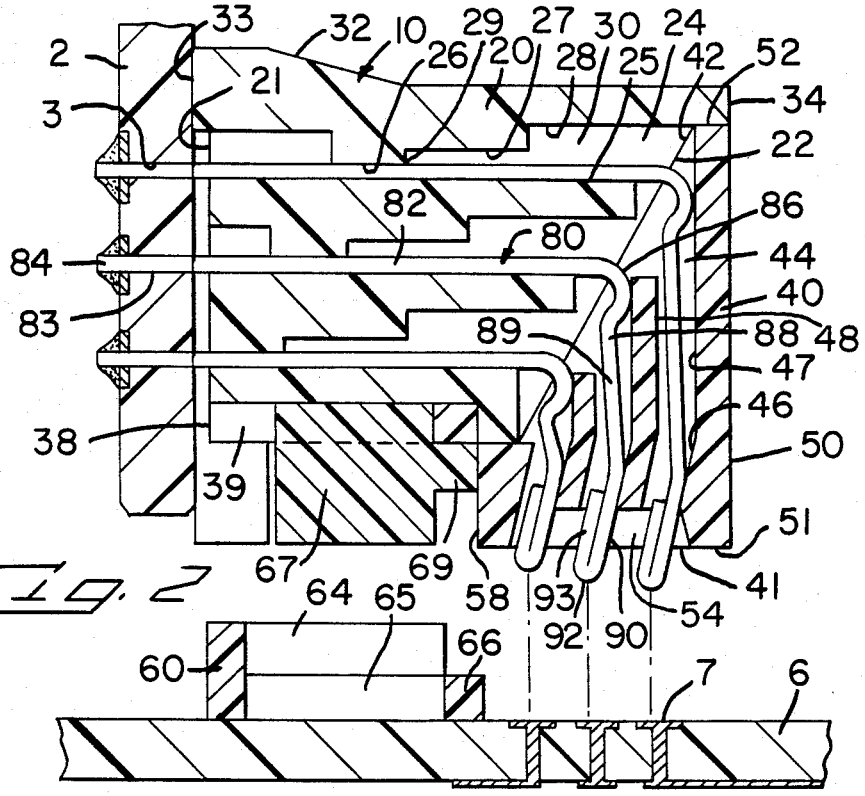
FIG. 2 is a cross section of the connector before mating to the mother board.

FIG. 2 is a cross section of the assembled connector 10 with housing portions 20, 40 fit together and held in place by key 67. The first portion 20 has rows of parallel first passage portions 24 therethrough from first outside or mating face 21 to inside face 22, which abuts inside face 42 of second housing portion 40, which has second passage portions 44 therethrough from face 42 to second outside or mating mating face 41. Together the passage portions 24, 44 form right angle passages which contain right angle contact elements 80 and insulate them from each other in parallel rows. The contact elements 80 each have a first arm 82 in a respective first passage portion 24 and a second arm 88 in a respective second passage portion 44; the arms 82, 88 meet at a bend 86 at the interface between housings 20, 40. Each first passage portion 24 is flanked by a generally flat first surface 25 and stepped first, second, and third surfaces 26, 27, 28 which oppose surface 25. The surfaces 25, 26 receive first arm 82 snugly therebetween and establish a fulcrum or fixing point 29 which fixes the arm 82 against lateral movement. Surfaces 27, 28 are progressively further from surface 25, and define therewith an enlarged portion 30 which permits lateral flexing of arm 82 between fixing point 29 and bend 86. Each first arm 82 has a pin portion 83 and a first end 84 which are received in through-holes 3 in daughter board 2 and soldered thereto after the connector 10 is screwed thereto (FIG. 1).

Referring still to FIG. 2, each second arm 88 of each terminal 80 has a compliant section 89 which extends from bend 86 to a bearing section 90, thence is lapped against itself to form a rounded second end 92 and lapped section 93. The bearing section 90 is resiliently disposed against a bearing surface 46 which extends obliquely to mating face 41. The bearing surfaces 46 of respective second passage portions 44 are inclined at about 10° from the perpendicular to mating face 41. The compliant sections 89 are spaced from straight surfaces 47 as well as opposed surface 48, so that arms 88 are free to move axially in respective passages 44 as will be described (FIG. 2). Note that ends 92 in the outer row of contact elements 80 extend slightly further from recess 54 in face 41 than the ends 92 of the terminals 80 in the inner row. Note that, while all terminals have like numbered components for simplicity, the arms 82, 89 are shortest in the inner row and longest in the outer row, as would be expected in a multi-row right angle connector.

Referring still to FIG. 2, the connector 10 is shown poised for mating with keying block 60. Keys 67 are vertically aligned with unoccupied apertures 64 in the block 60, and also serve to lock the housing portions 20, 40 together as will be described. Second ends 92 are vertically aligned with surface contacts 7.

Figure 3:
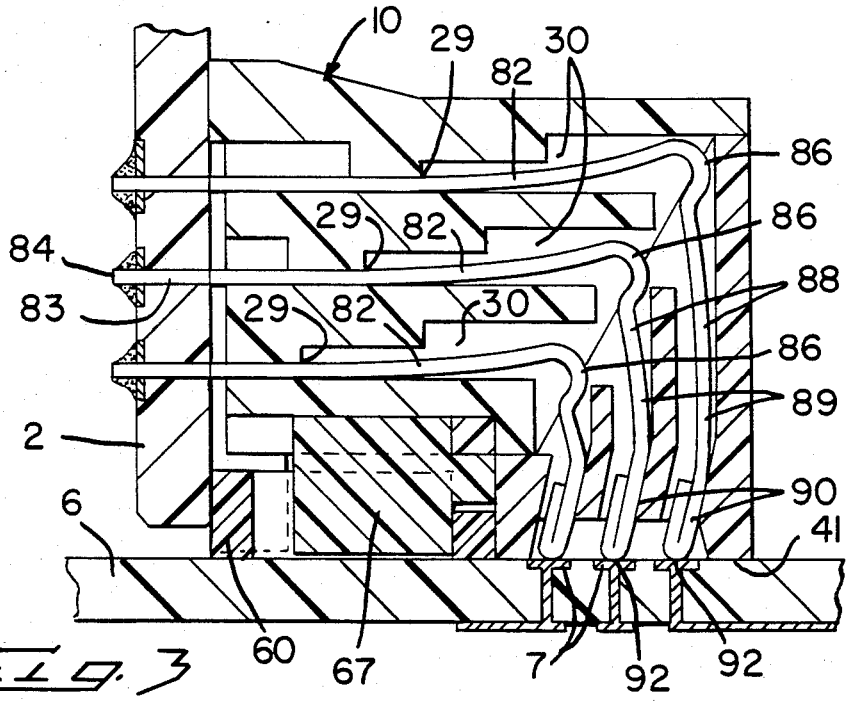
FIG. 3 is a cross section of the connector as mated.

FIG. 3 is a cross section of the connector 10 as mated to block 60, thus providing electrical connection between traces on daughter card 2 and surface contacts 7 on mother board 6. Each first arm between fulcrum or fixing point 29 and bend 86 is flexed into enlarged portion 30 of first passage portion 24 so that second ends 92 bear resiliently against respective surface contacts 7. The fixing points 29 are situated so that each second arm 82, whether in the inner, middle or outer row of passages, has approximately the same spring length between the respective fixing points 29 and bends 86. This assures substantially equal bearing forces between second ends 92 and surface contacts 7. Some flexure occurs in the compliant portion 89 of each second arm 88, with greater flexure in the outer row of passages. This is compensated by the further extension of ends 92 in the outer row from face 41 (FIG. 21), which further extension also compensates for any rocking of the connector 10 due to the moment created by the contact force.

Figure 4:
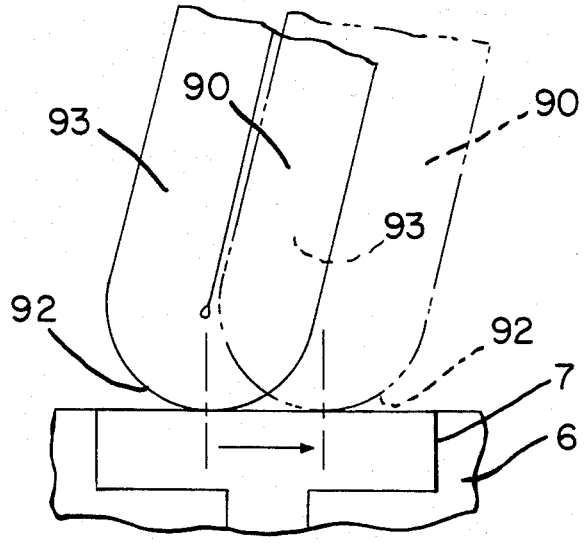
FIG. 4 is an enlarged side view showing the wiping contact action.

During installation of connector 10 on mother board 6 as illustrated in FIGS. 2 and 3, the oblique angle of the bearing sections 92 and the resilience thereof against respective bearing surfaces 46 causes a lateral shift of second ends 92 as they retreat vertically toward second mating face 41. This lateral shift, shown enlarged in FIG. 4, produces a wiping action between contact element ends 92 and surface contact 7, which wiping action assures a contact interface free of oxides and foreign matter which could affect the integrity of the electrical connection. The sheared edges extend slightly further than the center portion of the rolled surface on second end 92 and, therefore, provide a sharp edge which aids in scraping any build-up.

Figure 5:
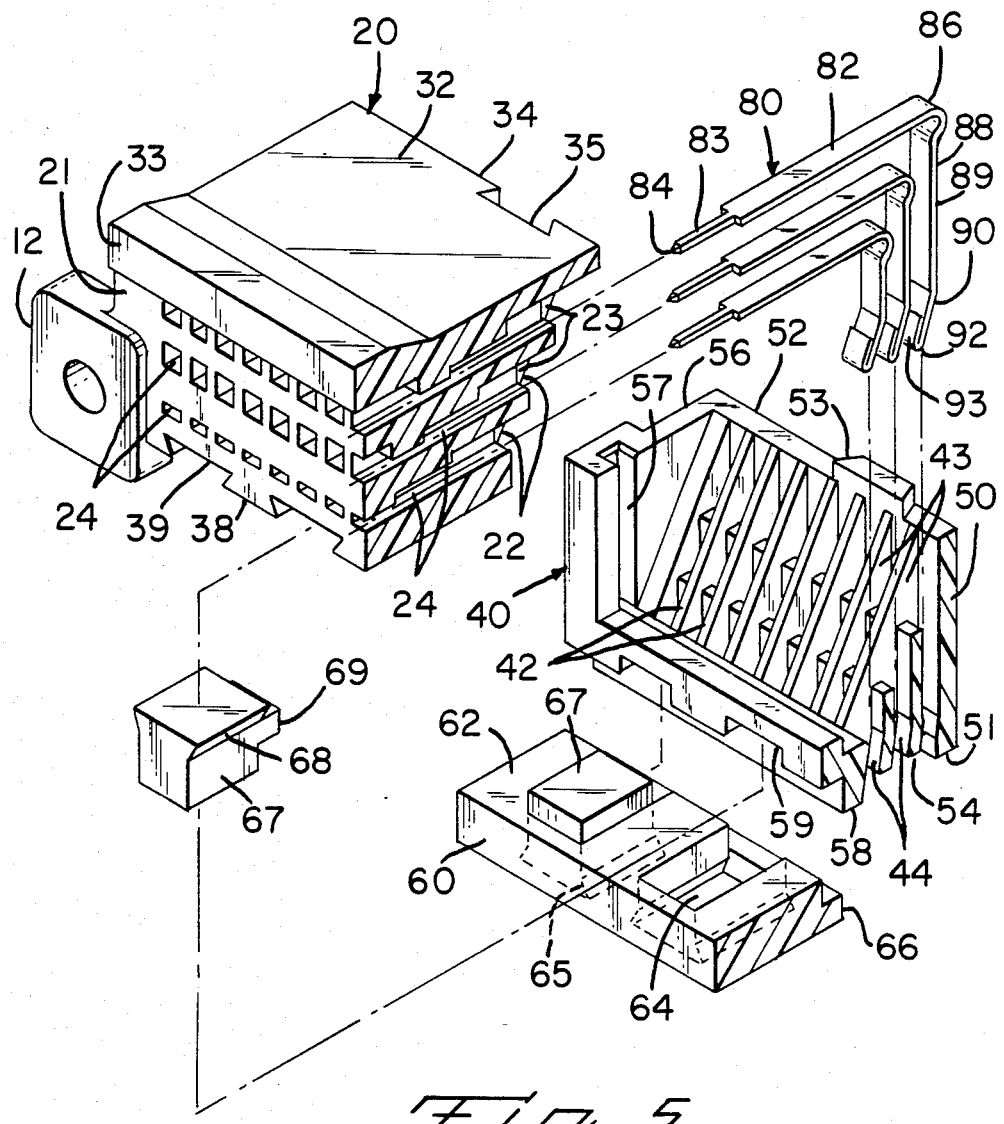
FIG. 5 is an exploded, partially sectioned perspective of the connector components.
Figure 5:
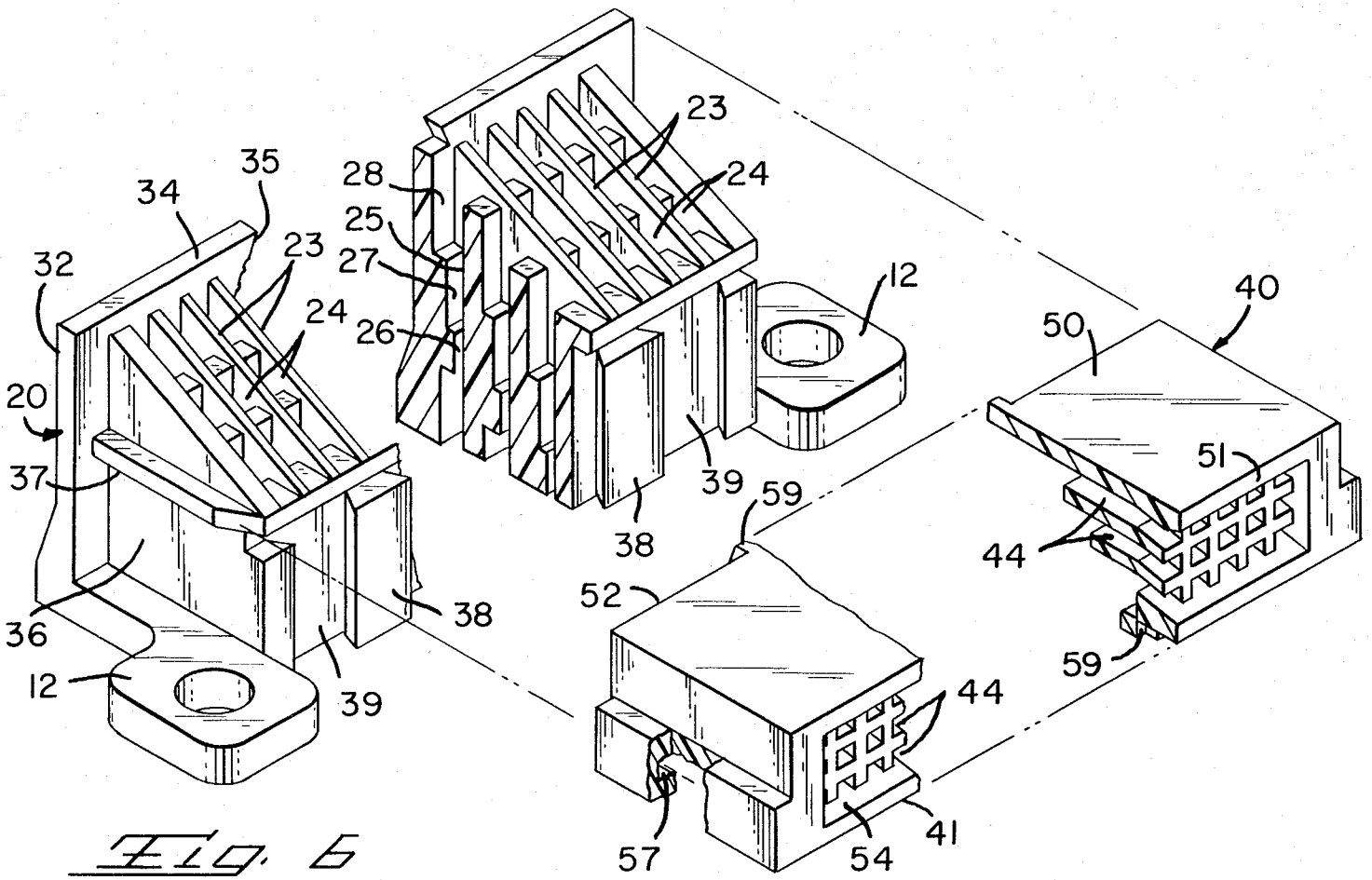

FIG. 5 is an exploded perspective looking toward the mating face 21 of first housing portion 20. The terminals 80 are shown in three sizes oriented as they would be when first arms 82 are inserted in respective first passage portions 24. Second housing portion 40 is then moved upward so that second arms 88 are received in second passage portions 44. Vertical barriers 23 between first passage portions 24 have angled face 22 thereon which meets flushly with angled inside face 42 on vertical barriers 43 between second passage portions 44 when assembly is completed. The grooves 57 in opposed endwalls 56 serve an aligning function by receiving ribs 37 (FIG. 6) on first housing portion 20. Dovetail cuts 35 in flange 34 receive dovetails 53 on flange 52. The housing portions 20, 40 are locked together by sliding the dovetails 68 on keys 67 into selected dovetail slots 39 in bottom wall 38 of housing portion 20 until the flanges 69 reside in respective keying recesses 59 of housing portion 40. The keying block 60 likewise has keys 67 inserted in selected apertures 64 from the bottom of block 60 so that dovetails 68 seat in respective dovetail lead-ins 65 and the keys protrude above top face 62 of the block. The block 60 is then fixed to mother board 6 by epoxy, screws, or other known means in a precise relationship with surface contacts 7 (FIG. 1). The keys 67 are emplaced in housing portion 20 in positions which correspond with unoccupied apertures 64 so that key placement determines which connectors can be mated with which keying block.

FIG. 6 offers a perspective of housings 20, 40 looking toward mating face 41, which has a recess 54 therein intersected by passages 44. The aligning fetures offered by ribs 37 in grooves 57 and dovetails 53 in cuts 35 are apparent, as are dovetail slots 39 in bottom wall 38. Passage portions 24 between vertical barriers 23 are profiled by inner surfaces 25 and opposed, stepped first, second and third surfaces 26, 27, 28 respectively.

Figure 7:
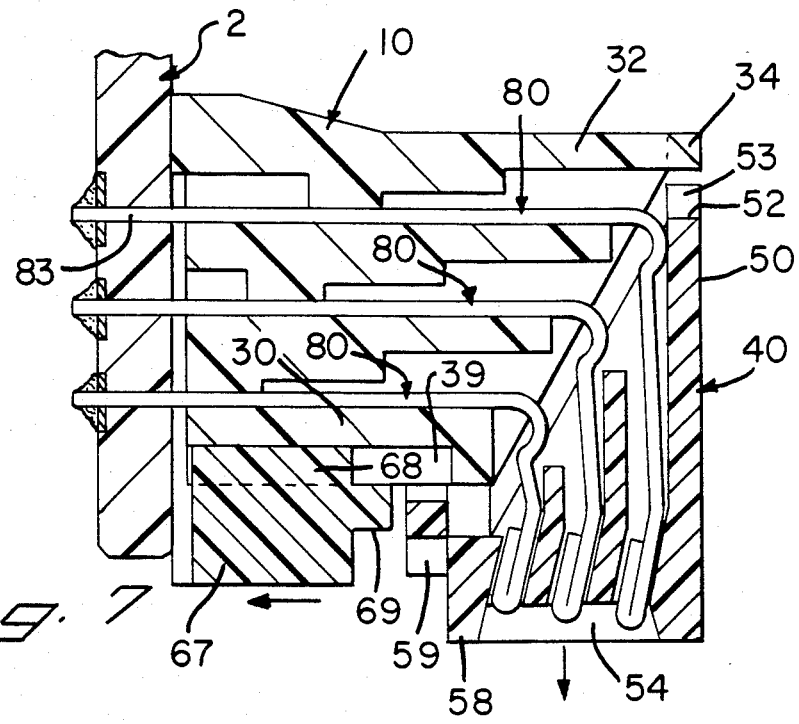
FIG. 7 is a cross section of the partially disassembled connector.

FIG. 7 illustrates the procedure followed if it is necessary to remove a contact element 80 after the connector 10 is assembled on a daughter board 2. Keys 67 in first housing portion 20 are slid in slots 39 toward daughter board 2 until flanges 69 depart from recesses 59, thence second housing portion 40 can be slid vertically as shown. Local heat would be provided at the pin 83 to melt solder thereat so the pin could be removed.

The above description is exemplary and not intended to limit the scope of the claims which follow.

We claim:

1. Electrical connector having a plurality of elongate right angle spring metal contact elements mounted in at least one row of respective passages through a housing, said housing having a first portion with a first outside face and a second portion with a second outside face, said second outside face being substantially perpendicular to said first mating face, said passage having a first portion opening on said first face and a second portion opening on said second face, said elements each having a first arm in a respective first portion of passage, a second arm in a respective second portion of passage, and a substantially right angle bend between said arms, said arms having respective first and second ends remote from said bend, said connector being characterized in that each said first arm is fixed against lateral movement at a fixing point in said first portion of said passage remote from said bend, each said passage between said fixing point and said bend being enlarged so that said first arm between said fixing point and said bend is free to deflect away from said second face when said second arm is moved axially in said second portion of passage away from said second face, whereby said second ends will comply resiliently with contacts brought to bear thereagainst.

2. An electrical connector as in claim 1 characterized in that said second portion of each said passage has a bearing surface therein which is disposed obliquely to said second face, said second arm having a bearing portion which is also disposed obliquely to said second face, said bearing portion being disposed resiliently against said bearing surface, whereby axial movement of said second arm will cause said second end thereof to shift laterally.

3. An electrical connector as in claim 2 characterized in that said second ends protrude beyond said second face, whereby upon moving said connector directly toward a surface with said second face parallel thereto, said second ends will contact said surface and shift thereacross as said second arms retreat resiliently into said housing.

4. An electrical connector as in claim 1 characterized in that said passages are disposed in inner and outer parallel rows, said first and second portions of passages in said inner row being shorter than respective first and second portions of passages in said outer row, said elements in said inner row of passages likewise having shorter first and second arms than respective first and second arms of elements in said outer row of passages, characterized in that the distance between said fixing point on said first arm in said inner row and the bend thereon is substantially the same as the distance between said fixing point on said first arm in said outer row and the bend thereon.

5. The connector of claim 1 characterized in that said passages are disposed in inner and outer parallel rows, said first and second portions of said inner row of passages being shorter than respective first and second portions of said outer row of passages, said elements in said inner row of passages likewise having shorter first and second arms than respective first and second arms of elements in said outer row of passages, characterized in that said second ends of said second arms in said outer row of passages extend further from the bends in the elements in said row, relative to the second face of the housing, than the second ends of said second arms in said inner row of passages extend from the bends in the elements in said row.

* * * * *